United States Patent [19]

Rowe

[11] 4,271,813

[45] Jun. 9, 1981

[54] BATTER ACTUATED BASEBALL PITCHING MACHINE

[76] Inventor: David Rowe, 204 Maple St., East Haven, Conn. 06512

[21] Appl. No.: 796,041

[22] Filed: May 11, 1977

[51] Int. Cl.[3] ..... F41B 3/02

[52] U.S. Cl. ..... 124/7; 124/34; 124/49; 124/41 R

[58] Field of Search ..... 124/4, 7, 6, 8, 36, 124/41 R, 34, 50, 49; 273/26 D, 95 R

[56] References Cited

U.S. PATENT DOCUMENTS

| | | | |
|---|---|---|---|
| 202,301 | 4/1878 | Taltavull | 124/7 |
| 1,203,027 | 10/1916 | McMillan | 273/26 D |
| 1,204,645 | 11/1916 | Boardman | 273/26 D X |
| 1,295,069 | 2/1919 | Rouen | 124/7 |
| 1,328,719 | 1/1920 | Condon | 124/7 |
| 2,009,256 | 7/1935 | Gensmer | 124/50 |
| 2,700,379 | 1/1955 | Brigati | 124/41 R X |
| 3,166,317 | 1/1965 | Tumelson | 273/26 E |
| 3,654,922 | 4/1972 | Outcalt | 128/75 |
| 3,774,584 | 11/1973 | Paulson | 273/26 D X |
| 4,082,076 | 4/1978 | Perry | 273/26 D |

FOREIGN PATENT DOCUMENTS

| | | | |
|---|---|---|---|
| 804301 | 4/1951 | Fed. Rep. of Germany | 124/7 |
| 2241221 | 3/1975 | France | 124/7 |

*Primary Examiner*—William R. Browne

[57] ABSTRACT

An inexpensive machine which pitches plastic baseballs. The machine is actuated by the user pulling, and then releasing a cord, as he brings his bat into a hitting position. The machine consists of a frame and two legs which form a tripod base, a ball rack containing a number of balls, a shaft attached to the frame, a torsion spring and a pitching arm are mounted on the shaft. A cord is attached to the pitching arm, and passes in the path of the balls restricting their movement until such time as the batter pulls this cord, causing a ball to roll into the arm and also spring loading the pitching arm. Release of this cord causes the machine to pitch the ball.

3 Claims, 4 Drawing Figures

BATTER ACTUATED BASEBALL PITCHING MACHINE

The machine is designed to pitch plastic baseballs. It is a mechanical machine which is operated by and receives its energy from the batter. It is actuated by means of a cord running between the batter and the machine.

The machine serves many purposes. First it provides a child with a backyard toy which he can use at times when there is no one for him to play with. Second it also provides both exercise and challange and third it can be used to develope the skills and reflexes required to become a proficient baseball hitter.

The machine is designed as a simple and inexpensive mechanism which will be within the price range of most children.

The following is a description of the views describing the invention.

Figure 1:
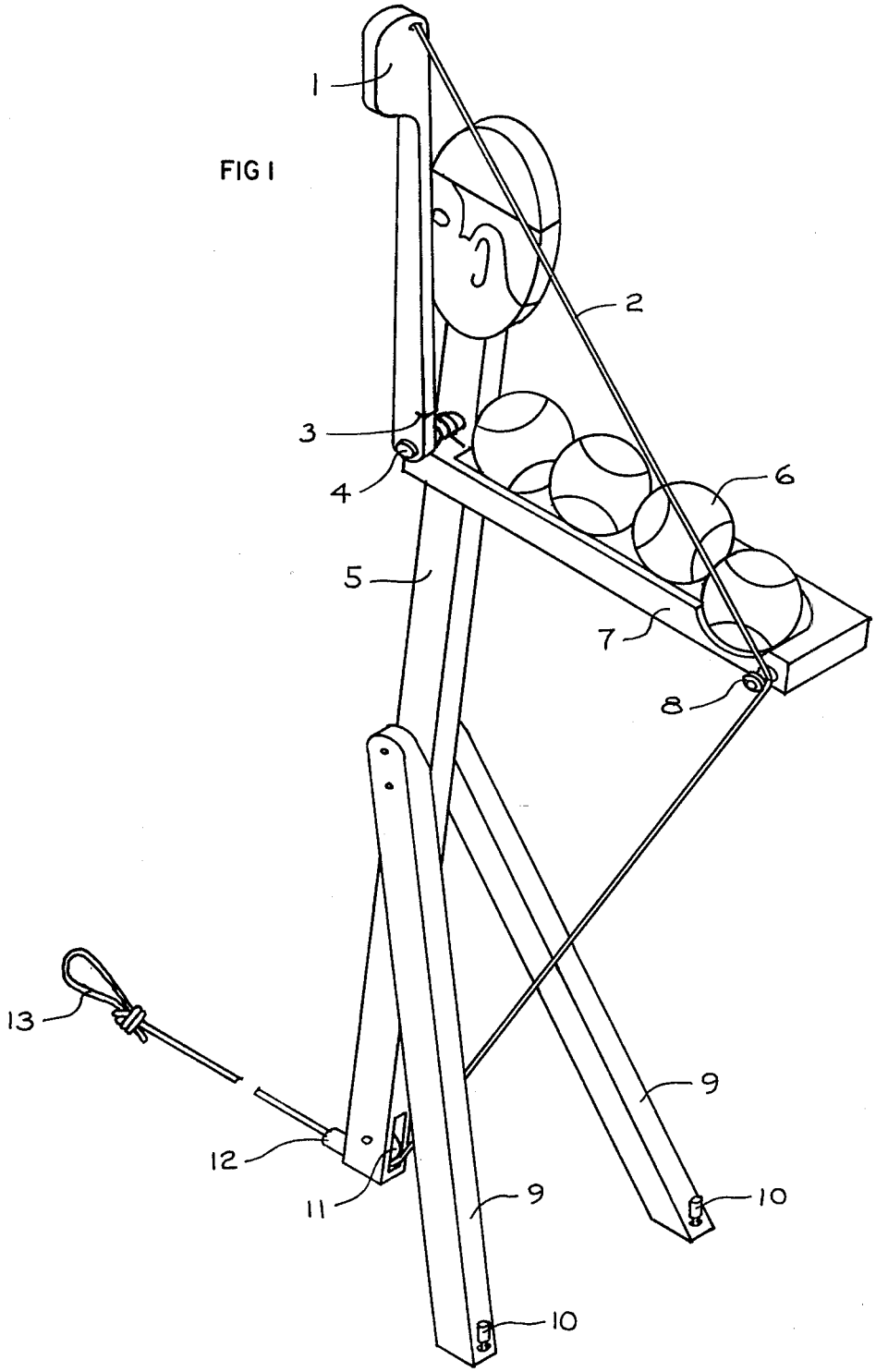
FIG. 1 is an isometric view of the pitching machine.

The machine consists of a main frame (5) which also serves as one of the machine legs. It has two other legs (9) which are bolted to the frame. These two legs (9) are fixed to the ground by two stakes (10). Projecting from the frame to the rear is the ball rack (7), which slopes slightly downward and is filled with a number of balls (6). A shaft (4) projects from the frame. A torsion coil spring (3) is mounted on this shaft and is fixed at one end to the frame and at the opposite end to the pitching arm (1). The pitching arm (1) is mounted on the shaft (4). A cord (2) runs from the pitching arm (1) downward to the rear, to pulley (8), passing in the path of balls (6) and thus preventing their movement. It passes over pulley (8) and then procedes downward and passes over pulley (11) which is mounted in a slot in the frame (5). The cord (2) then runs away from the machine at which point it ends in a loop (13). Stop (12) limits the movement of the cord (2) and is threaded onto and fixed to the cord. Stop (12) is made of resilient material and also acts as a shock absorber. Pulley (8) acts as a stop to limit motion of arm (1) when the arm (1) is drawn into the cocked position.

Figure 2:
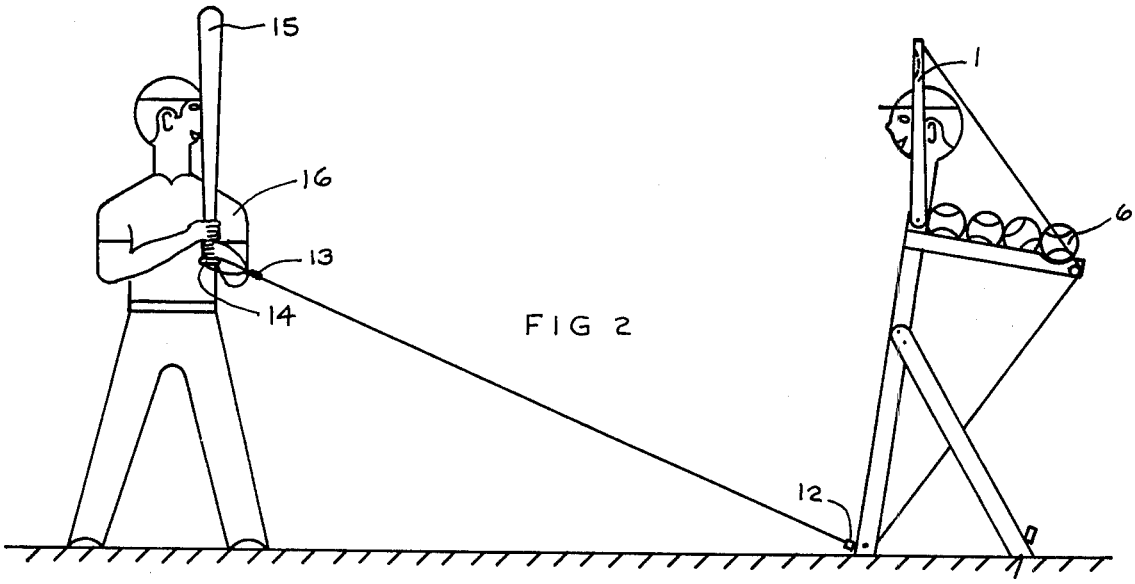
FIG. 2 is a side elevation view of the pitching machine and the batter after he has placed the loop of the cord on the handle of his bat.
Figure 3:
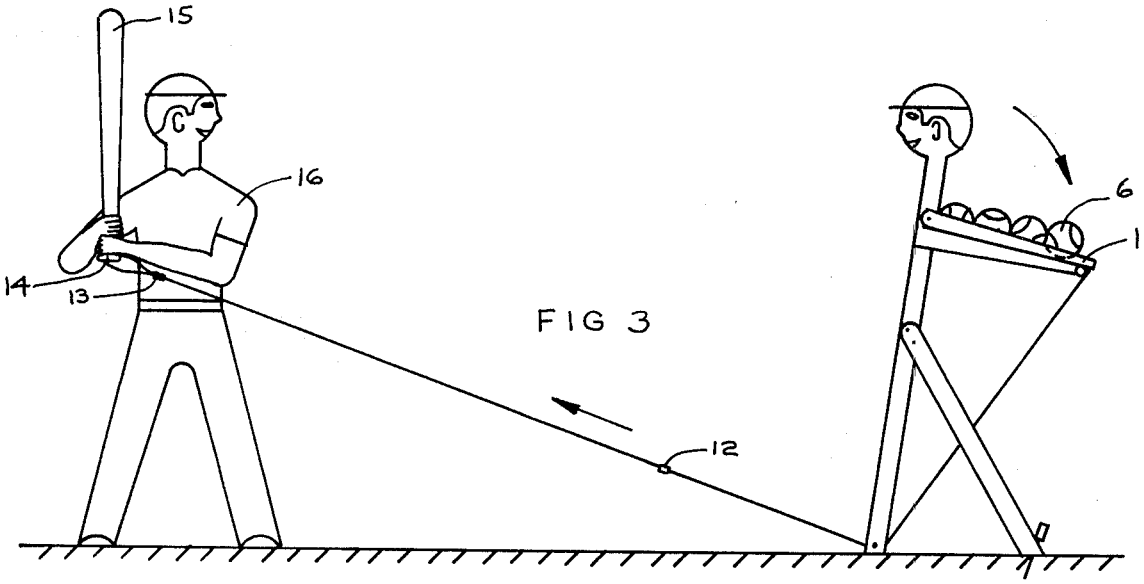
FIG. 3 is a side elevation view of the machine after the batter has moved his hands away from the machine into a batting position, thus cocking the pitching arm.

To operate the machine the batter (16) assumes a position approximately twenty-five feet in front of the machine. He picks up the loop (13) and places it on the handle (14) of the bat (15). The batter (16) then assumes a position as shown in FIG. 2 with his hands in a forward position and his feet in a good batting position. Next the batter (16) moves his hands away from the machine to a position as shown in FIG. 3. This movement of the batters hands pulls loop (13) causing it to move away from the machine. This movement of the loop (13) causes the cord (2) to flow through pullies (11) and (8). The cord (2) moves until the arm (1), comes in contact with pulley (8). As the cord has moved it has drawn the pitching arm (1) through a 90° arc pivioting about shaft (4). The cord (2) which has been acting as a ball stop and arm (1) are now at a level below the ball (6). The balls (6) then flow backward caused by the slight downward slope of the rack. The ball (6) farthest to the rear rolls until it falls into the pitching arm (1), as shown in FIG. 3. This ball (6) resting in the arm (1) causes the stream of balls (6) to come to a stop. As arm (1) has moved through a 90° arc it has caused the torsion coil spring (3) to coil about shaft (4). The machine is now ready to pitch a ball (6).

Figure 4:
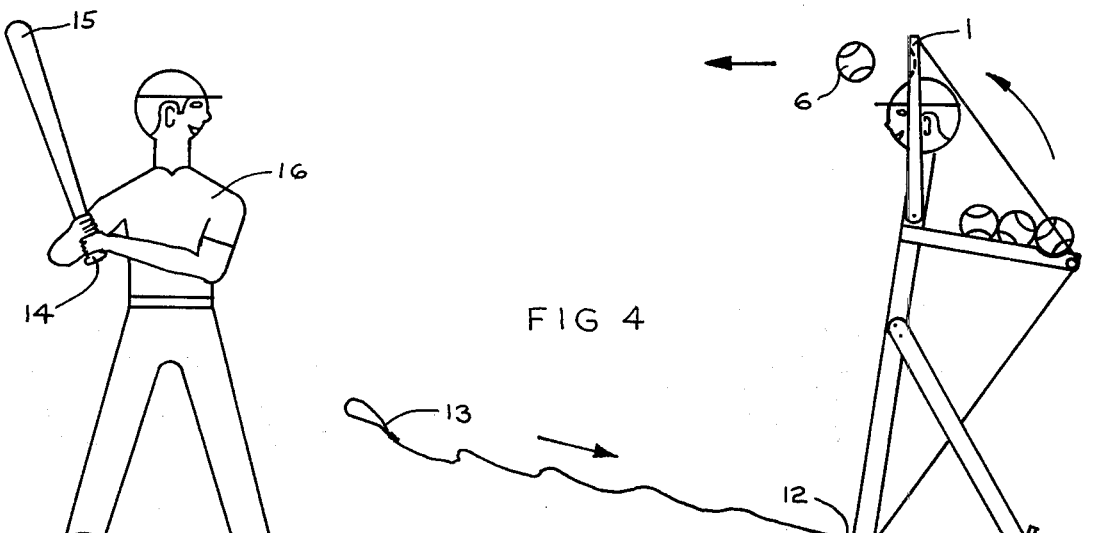
FIG. 4 is a side elevation view of the machine after the batter has let the cord slide from the handle thus actuating the machine. The arm has come to an abrupt stop and the ball is on its way to the batter.

The batter now twists his bat slightly allowing the loop (13) to slide off the handle (14) of his bat (15) as shown in FIG. 4. The torsion coil spring (3) now takes over causing the arm (1) to swing an arc counter clockwise from the view of the drawings. As the arm swings its arc it pulls the cord (2) along with it and as the cord (2) moves upward it takes over again as a ball stop. When the arm (1) has reached the vertical position as shown in FIG. 4 the combination stop and shock absorber (12) which is larger in size than the slot in the frame (5), interfers with frame (5) causing the cord (2) and arm (1) to come to an abrupt stop. The ball which is now traveling horizontally continues this motion toward the batter (16). When the ball comes within range of the batter (16) he swings and hits the ball (6).

The batter (16) then repeats this cycle until all the balls (6) are pitched. He then collects the balls (6), places them in the ball rack (7) and repeats the cycle.

What is claimed is:

1. A ball throwing device comprising a one piece frame extending in an upward direction; legs attached to said frame; a ball rack attached to said frame and having a ball outlet; a shaft projecting from said frame; an arm mounted on said shaft for pivotal movement relative to said frame; a spring mounted on said shaft and biassing said arm in one direction; a cord, one end of which is attached to said arm for pivoting said arm in a direction opposite to said one direction to a position proximate said ball outlet for engagement with a ball at said outlet; means for guiding said cord; and a stop fixed to said cord for engagement with said guiding means to limit pivoting of said opposite direction.

2. A ball throwing device comprising a one piece frame extending in a generally vertical direction; two legs attached to and sloping downward and away from said frame; a ball rack for containing a number of balls and attached directly to and sloping downward and rearward from said frame and having a ball outlet; a shaft projecting from said frame; an arm mounted on said shaft for pivotal movement relative to said frame; a spring mounted on said shaft one end of which is attached to said arm for biassing said arm in one direction; a cord guide on said ball rack; a hole in said frame near the bottom thereof; a cord attached to said arm for pivoting said arm in a direction opposite to said one direction, said cord extending, when said arm has been pivoted in said one direction, downward across the path of a ball at said ball outlet, over said cord guide, through said hole in said frame and then away from said frame; and a stop fixed to said cord for engagement with said cord guide to limit pivoting of said arm in said opposite direction.

3. A ball throwing device comprising a ball rack for retaining a number of balls, said ball rack sloping downward and having a ball outlet in a lower portion thereof, a throwing arm so mounted and located that when moved in a first direction a portion of said arm will be located in position to engage a ball which has exited from said outlet, means biassing said throwing arm in a second direction for propelling the engaged ball, a cord, means connecting said cord to said throwing arm for moving said arm in said first direction into said ball engaging position when a pulling force is exerted on said cord, and means guiding said cord whereby a portion thereof will, while the throwing arm is moved out of said ball-engaging position, be disposed in position to block said ball outlet.

* * * * *